US011578287B1

(12) United States Patent
Giles et al.

(10) Patent No.: US 11,578,287 B1
(45) Date of Patent: Feb. 14, 2023

(54) MIXED FLEET CAPABLE LUBRICATING COMPOSITIONS

(71) Applicant: Afton Chemical Corporation, Richmond, VA (US)

(72) Inventors: Nicholas Giles, Glen Allen, VA (US); Abaigeal Ritzenthaler, Richmond, VA (US); Leah Donham, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 17/557,828

(22) Filed: Dec. 21, 2021

(51) Int. Cl.

| | |
|---|---|
| ***C10M 137/10*** | (2006.01) |
| ***C10M 125/22*** | (2006.01) |
| ***C10M 129/10*** | (2006.01) |
| *C10N 40/25* | (2006.01) |
| *C10N 10/04* | (2006.01) |
| *C10N 30/04* | (2006.01) |
| *C10N 30/06* | (2006.01) |

(52) U.S. Cl.
CPC ..... *C10M 137/10* (2013.01); *C10M 125/22* (2013.01); *C10M 129/10* (2013.01); *C10M 2201/084* (2013.01); *C10M 2207/023* (2013.01); *C10M 2223/045* (2013.01); *C10N 2010/04* (2013.01); *C10N 2030/04* (2013.01); *C10N 2030/06* (2013.01); *C10N 2040/252* (2020.05); *C10N 2040/255* (2020.05)

(58) Field of Classification Search
CPC ..... C10M 137/10; C10M 125/22; C10M 129/10; C10M 2201/084; C10M 2207/023; C10M 2223/045; C10N 2010/04; C10N 2030/04; C10N 2030/06; C10N 2040/252; C10N 2040/255
USPC ..... 508/192
See application file for complete search history.

(56) References Cited

U.S. PATENT DOCUMENTS

| | | | | |
|---|---|---|---|---|
| 5,362,419 | A | 11/1994 | Zinke et al. | |
| 5,578,236 | A | 11/1996 | Srinivasan et al. | |
| 5,922,657 | A | 7/1999 | Camenzind et al. | |
| 6,451,745 | B1 | 9/2002 | Ward | |
| 2006/0063685 | A1 | 3/2006 | Purmer et al. | |
| 2006/0264340 | A1 | 11/2006 | Iyer et al. | |
| 2009/0233822 | A1 | 9/2009 | Iyer | |
| 2009/0233823 | A1 | 9/2009 | Fahl et al. | |
| 2013/0008756 | A1 | 1/2013 | Noles, Jr. et al. | |
| 2014/0038866 | A1 | 2/2014 | Barton | |
| 2014/0097059 | A1 | 4/2014 | Tang et al. | |
| 2015/0210953 | A1* | 7/2015 | Davies | C10M 161/00 508/370 |
| 2018/0346839 | A1* | 12/2018 | Fletcher | C10M 159/22 |

FOREIGN PATENT DOCUMENTS

| | | | |
|---|---|---|---|
| CN | 102575186 | A | 7/2012 |
| EP | 0894845 | A1 | 2/1999 |
| EP | 1233054 | A1 | 8/2002 |
| EP | 1262538 | A2 | 12/2002 |
| EP | 0856042 | B1 | 1/2003 |
| EP | 1529831 | A2 | 5/2005 |

OTHER PUBLICATIONS

Huanmou et al., "Lubricity of Carboxyl Acid Derivatives of O,O-dialkyl-phosphorodithioate," Journal of Hunan University, vol. 23, No. 3, (1996), pp. 65-70.

* cited by examiner

*Primary Examiner* — Prem C Singh
*Assistant Examiner* — Francis C Campanell
(74) *Attorney, Agent, or Firm* — Honigman LLP

(57) ABSTRACT

This disclosure describes lubricating additives and lubricants including such additives suitable for and/or configured for mixed fleet use and, for instance, additives and lubricants that satisfy performance standards for typical spark ignition passenger car lubricants as well as performance standards for lubricants suitable for typical compression ignition heavy duty engine applications.

27 Claims, No Drawings

MIXED FLEET CAPABLE LUBRICATING COMPOSITIONS

TECHNICAL FIELD

This disclosure relates to additive systems and lubricating compositions including the additive systems configured for mixed fleet use and, in particular, lubricating compositions capable of meeting the performance criteria for both compression ignition heavy duty and spark-ignition passenger car applications.

BACKGROUND

Automotive manufacturers continue to the push for improved efficiency and fuel economy, and as such, demands on engines, lubricants, and their components continue to increase. Today's spark-ignition passenger car engines are often smaller, lighter and more efficient with technologies designed to improve fuel economy, performance, and power. Engines for compression ignition heavy duty applications, on the other hand, are often designed for heavier loads, operation at or near peak power output, extreme conditions and/or more cyclic-type operations, but such engines still need to meet strict standards for improved efficiency and fuel economy. These requirements also mean engine oil performance must evolve to meet the higher demands of such modern engines and their corresponding performance criteria tied to their unique use and applications. With such exacting demands for engine oils, lubricant manufacturers often tailor lubricants and their additives to meet certain performance requirements for each unique application, such as fluids configured for compression ignition heavy duty engines or fluids configured for passenger car applications. Typically, each application requires specific performance standards such that a lubricant designed for one application would not satisfy all the performance specifications for a different application.

For example, American Petroleum Institute (API) sets standards for passenger car motor oils designed to meet the needs and performance characteristics of various passenger car automobile manufacturers. Recent updates to API standards include performance testing relating to an undesired phenomenon typically characterized as low-speed pre-ignition (or LSPI), which is believed to be a form of combustion that results with ignition of the air-fuel mixture in the combustion chamber prior to the desired ignition. Often, turbocharged or supercharged engines, may be prone to LSPI, which is a pre-ignition event that may include high pressure spikes, early combustion, and/or knock. A premature ignition in the combustion chamber, generated prior to the spark plug firing, may cause an abnormal combustion and high cylinder pressure. The LSPI event may result in a knocking sound or other abnormal characteristics from the uncontrolled pressure rise in the cylinder. LSPI events are undesired and recent API specifications set LSPI performance standards for passenger car motor oils.

Lubricants designed for compression ignition heavy duty engine applications such as heavy duty diesel engines, on the other hand, tend to be more focused on suitability for truck engines, fleet operators, mining houses, and construction equipment engines to suggest but a few applications. Fluids for such applications, thus, often focus on different performance characteristics than typical passenger cars. Lubricants for heavy duty use, for instance, are often used in diesel engines and configured to maintain friction and viscosity performance with soot and/or sludge control that may be inherent to more heavy duty applications.

However, due to the unique performance requirements for spark ignition passenger car motor oils as compared to compression ignition heavy duty application, fluids designed for one application do not necessarily meet the performance standards for the other. For instance, lubricants designed for spark ignition passenger car standards would not necessary meet the friction requirements for compression ignition heavy duty applications and fluids for compression ignition heavy duty applications would not necessarily meet the LSPI performance standards for spark ignition passenger car applications.

SUMMARY

In one approach or embodiment, a lubricating composition suitable for compression-ignition heavy duty applications and spark-ignition engines. In one aspect, the lubricating composition includes a detergent system providing both calcium and magnesium from one or more of a sulfonate, a phenate, a salicylate, or mixtures thereof; an antiwear and friction system including one or more metal dialkyl dithiophosphates derived from primary and secondary alcohols, and wherein a weight ratio of primary to secondary alcohols in the antiwear and friction system is at least about 3:1; wherein the amount of magnesium from the detergent system is at least 500 ppm magnesium based on the lubricating composition; and wherein the amount of phosphorus from the antiwear and friction system is less than 1200 ppm phosphorus based on the lubricating composition (in other approaches or embodiments, less than 1000 ppm phosphorus or less than 800 ppm phosphorus) and the amount of zinc from the antiwear and friction system is less than 1000 ppm zinc based on the lubricating composition.

In other embodiments or approaches, the composition may include optional embodiments or features in any composition. Such optional features or embodiments include one or more of the following: wherein the calcium provided by the detergent system is provided by one or more of a calcium phenate, a calcium sulfonate, or mixtures thereof and in amounts to provide about 900 to about 1500 ppm of calcium; and/or wherein a weight ratio of the calcium to magnesium provided by the detergent system is about 1.5:1 to about 2:1; and/or wherein the detergent system includes about 50 to about 70 weight percent of calcium phenate, about 30 to about 40 weight percent of magnesium sulfonate, and 0 to about 10 weight percent of calcium sulfonate; and/or wherein the detergent system includes about 60 to about 70 weight percent of the calcium phenate, about 32 to about 38 weight percent of the magnesium sulfonate, and about 1 to about 4 weight percent of the calcium sulfonate; and/or wherein the calcium sulfonate has a total base number of less than 50; and/or wherein the antiwear and friction system includes two zinc dialkyl dithiophosphates; and/or wherein the antiwear and friction system includes a first zinc dialkyl dithiophosphate derived from primary alcohols and a second zinc dialkyl dithiophosphate derived from a mixture of primary and secondary alcohols; and/or wherein the antiwear and friction system includes one or more zinc dialkyl dithiophosphate additives derived from a majority of primary alcohols; and/or wherein the antiwear and friction system includes up to about 60 weight percent of the first zinc dialkyl dithiophosphate derived from primary alcohols and about 40 to about 50 weight percent of the second zinc dialkyl dithiophosphate derived from a mixture of primary and secondary alcohols; and/or wherein the second zinc dialkyl dithiophosphate derived from a mixture of primary and secondary alcohols is derived from about 50 to about 70 weight percent primary alcohols and about 30 to about 50 weight percent secondary alcohols; and/or wherein the detergent system includes a calcium sulfonate with a neat total base number of 20 to 80; and/or wherein the detergent system includes a calcium phenate with a neat total base number of 300 to 450 and a magnesium sulfonate with a neat total base number of about 500 to about 700; and/or wherein the total base number of the lubricating composition is less than about 15 (in other approaches, less than about 12, or even less than about 10); and/or further comprising a viscosity modifier additive selected from polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof; and/or wherein the lubricating composition includes no more than about 9 weight percent of the viscosity modifier additive; and/or wherein the lubricating composition exhibits no more than 5 average events pursuant to a Sequence IX low speed pre-ignition test pursuant to ASTM D8291-21a using two iterations; and/or wherein the lubricating composition has an absolute value percent change from initial slip time of about 10 percent or less pursuant to Allison Transmission friction test TES-439 (November 2010) and an absolute value percent change from initial friction coefficient (midpoint) of 10 percent or less pursuant to Allison Transmission friction test TES-439 (November 2010).

In another embodiment, a method of lubricating an engine with a lubricating composition that conforms with API SP, API CK-4, and API FA-4 certifications. In some aspects, the method includes lubricating the engine with a lubricating composition wherein the lubricating composition includes a detergent system providing both calcium and magnesium from one or more of a sulfonate, a phenate, a salicylate, or mixtures thereof; and an antiwear and friction system including one or more zinc dialkyl dithiophosphates derived from primary and secondary alcohols, and wherein a weight ratio of primary to secondary alcohols in the antiwear and friction system is at least about 3:1; wherein the amount of magnesium from the detergent system is greater than 500 ppm magnesium based on the lubricating composition; and wherein the amount of phosphorus from the antiwear and friction system is less than 1200 ppm phosphorus based on the lubricating composition (in other embodiments, less than 1000 ppm phosphorus or less than 800 ppm phosphorus) and the amount of zinc from the antiwear system is less than 1000 ppm zinc based on the lubricating composition; and wherein the wherein the lubricating composition exhibits no more than 5 average events pursuant to a Sequence IX low speed pre-ignition test pursuant to ASTM D8291-21a when using two iterations and wherein the lubricating composition has an absolute value percent change from initial slip time of about 10 percent or less pursuant to Allison Transmission friction test TES-439 (November 2010) and an absolute value percent change from initial friction coefficient (midpoint) of 10 percent or less pursuant to Allison Transmission friction test TES-439 (November 2010).

In other embodiments or approaches, the methods may include optional embodiments, steps, or features in any composition. Such optional features, steps, or embodiments include one or more of the following: wherein the calcium provided by the detergent system is provided by one or more of a calcium phenate, a calcium sulfonate, or mixtures thereof and in amounts to provide about 900 to about 1500 ppm of calcium; and/or wherein a weight ratio of the calcium to magnesium provided by the detergent system is about 1.5:1 to about 2:1; and/or wherein the detergent system includes about 50 to about 70 weight percent of a calcium phenate, about 30 to about 40 weight percent of a magnesium sulfonate, and about 0 to about 10 weight percent of a calcium sulfonate; and/or wherein the detergent system includes about 60 to about 70 weight percent of the calcium phenate, about 32 to about 38 weight percent of the magnesium sulfonate, and about 1 to about 4 weight percent of the calcium sulfonate; and/or wherein the calcium sulfonate has a total base number of less than 50; and/or wherein the antiwear and friction system includes a first zinc dialkyl dithiophosphate derived from primary alcohols and a second zinc dialkyl dithiophosphate derived from a mixture of primary and secondary alcohols; and/or wherein the antiwear and friction system includes one or more zinc dialkyl dithiophosphate additives derived from a majority of primary alcohols; and/or wherein the antiwear and friction system includes up to about 60 weight percent of a first zinc dialkyl dithiophosphate derived from primary alcohols and about 40 to about 50 weight percent of a second zinc dialkyl dithiophosphate derived from a mixture of primary and secondary alcohols; and/or wherein the second zinc dialkyl dithiophosphate derived from a mixture of primary and secondary alcohols is derived from about 50 to about 70 weight percent primary alcohols and about 30 to about 50 weight percent secondary alcohols; and/or wherein the detergent system includes a calcium sulfonate with a neat total base number of 20 to 80; and/or wherein the detergent system includes a calcium phenate with a neat total base number of 300 to 450 and a magnesium sulfonate with a neat total base number of about 500 to about 700.

In yet other embodiments, the present disclosure provides for the use of any embodiment of the lubricating compositions of this Summary for API SP, API CK-4, and API FA-4 certifications and, in particular, for achieving more than 5 average events pursuant to a Sequence IX low speed pre-ignition test pursuant to ASTM D8291-21a when using two iterations and achieving an absolute value percent change from initial slip time of about 10 percent or less pursuant to Allison Transmission friction test TES-439 (November 2010) and an absolute value percent change from initial friction coefficient (midpoint) of 10 percent or less pursuant to Allison Transmission friction test TES-439 (November 2010).

Other embodiments of the present disclosure will be apparent to those skilled in the art from consideration of the specification and practice of the invention disclosed herein. The following definitions of terms are provided in order to clarify the meanings of certain terms as used herein.

The terms "lubricating oil," "lubricant composition," "lubricating composition," "lubricant" and "lubricating fluid" refer to a finished lubrication product comprising a major amount of a base oil plus a minor amount of an additive composition.

As used herein, the terms "additive package," "additive concentrate," or "additive composition" refer the portion of the lubricating oil composition excluding the major amount of base oil.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having a predominantly hydrocarbon character. Each hydrocarbyl group is independently selected from hydrocarbon substituents, and substituted hydrocarbon substituents containing one or more of halo groups, hydroxyl groups, alkoxy groups, mercapto groups, nitro groups, nitroso groups, amino groups, pyridyl groups, furyl groups, imidazolyl groups, oxygen and nitrogen, and wherein no more than two non-hydrocarbon substituents are present for every ten carbon atoms in the hydrocarbyl group.

As used herein, the term "percent by weight" or "wt %", unless expressly stated otherwise, means the percentage the recited component represents to the weight of the entire composition. All percent numbers herein, unless specified otherwise, is weight percent.

The terms "soluble," "oil-soluble," or "dispersible" used herein may, but does not necessarily, indicate that the compounds or additives are soluble, dissolvable, miscible, or capable of being suspended in the oil in all proportions. The foregoing terms do mean, however, that they are, for instance, soluble, suspendable, dissolvable, or stably dispersible in oil to an extent sufficient to exert their intended effect in the environment in which the oil is employed. Moreover, the additional incorporation of other additives may also permit incorporation of higher levels of a particular additive, if desired.

The term "alkyl" as employed herein refers to straight, branched, cyclic, and/or substituted saturated chain moieties from about 1 to about 200 carbon atoms. The term "alkenyl" as employed herein refers to straight, branched, cyclic, and/or substituted unsaturated chain moieties from about 3 to about 30 carbon atoms. The term "aryl" as employed herein refers to single and multi-ring aromatic compounds that may include alkyl, alkenyl, alkylaryl, amino, hydroxyl, alkoxy, halo substituents, and/or heteroatoms including, but not limited to, nitrogen, and oxygen.

As used herein, the molecular weight is determined by gel permeation chromatography (GPC) using commercially available polystyrene standards (with a Mn of about 180 to about 18,000 as the calibration reference). The number average molecular weight (Mn) for any embodiment herein may be determined with a gel permeation chromatography (GPC) instrument obtained from Waters or the like instrument and the data processed with Waters Empower Software or the like software. The GPC instrument may be equipped with a Waters Separations Module and Waters Refractive Index detector (or the like optional equipment). The GPC operating conditions may include a guard column, 4 Agilent PLgel columns (length of 300×7.5 mm; particle size of 5μ, and pore size ranging from 100-10000 Å) with the column temperature at about 40° C. Un-stabilized HPLC grade tetrahydrofuran (THF) may be used as solvent, at a flow rate of 1.0 mL/min. The GPC instrument may be calibrated with commercially available polystyrene (PS) standards having a narrow molecular weight distribution ranging from 500-380,000 g/mol. The calibration curve can be extrapolated for samples having a mass less than 500 g/mol. Samples and PS standards can be in dissolved in THF and prepared at concentration of 0.1-0.5 weight percent and used without filtration. GPC measurements are also described in U.S. Pat. No. 5,266,223, which is incorporated herein by reference. The GPC method additionally provides molecular weight distribution information; see, for example, W. W. Yau, J. J. Kirkland and D. D. Bly, "Modern Size Exclusion Liquid Chromatography", John Wiley and Sons, New York, 1979, also incorporated herein by reference.

It is to be understood that throughout the present disclosure, the terms "comprises," "includes," "contains," etc. are considered open-ended and include any element, step, or ingredient not explicitly listed. The phrase "consists essentially of" is meant to include any expressly listed element, step, or ingredient and any additional elements, steps, or ingredients that do not materially affect the basic and novel aspects of the invention. The present disclosure also contemplates that any composition described using the terms, "comprises," "includes," "contains," is also to be interpreted as including a disclosure of the same composition "consisting essentially of" or "consisting of" the specifically listed components thereof.

DETAILED DESCRIPTION

In one aspect, this disclosure describes lubricating additives and lubricants including such additives suitable for and/or configured for mixed-fleet use and, for instance, unique additives and lubricants that satisfy performance standards for typical spark-ignition passenger car lubricants as well as performance standards for lubricants suitable for typical compression-ignition heavy duty engine applications. Thus, the fluids herein are mixed fleet capable and configured for and/or capable of being used in one or both applications as needed for the circumstances.

In other approaches, the lubricating compositions described herein are suitable for diesel and gasoline engine applications. The lubricating compositions include at least a base oil of lubricating viscosity and a unique detergent system combined with a distinctive antiwear and friction system that achieves, for instance, both the LSPI performance standards designed for spark ignition passenger cars and also the friction performance for compression ignition heavy duty engine applications. Previously, fluids designed to meet LSPI requirements did not necessarily meet heavy duty engine friction requirements and fluids designed for heavy duty friction requirements would not necessarily satisfy the LSPI requirements for passenger cars. The fluids herein meet both characteristics.

In one approach, the lubricating compositions herein include a base oil or blend of base oils and (i) a detergent system with a plurality of additives that provide calcium and magnesium from one or more of a sulfonate, a phenate, a salicylate, or mixtures thereof and may include or consist essentially of calcium phenate and magnesium sulfonate and optionally calcium sulfonate and (ii) an antiwear and friction system that includes or consists essentially of one or more, and preferably a mixture of, metal dialkyl dithiophosphates, preferably a mixture of zinc dialkyl thiophosphates, derived from a blend of primary and secondary alcohols, and in approaches, includes a specific blend of metal dialkyl dithiophosphates within the total mixture derived from primary to secondary alcohols where a weight ratio of primary to secondary alcohols used to form the metal dialkyl dithiophosphates in the antiwear and friction system is at least 3:1.

In other approaches, the lubricating composition further includes certain amounts of magnesium, phosphorus, and metal (preferably zinc) in the finished fluid to achieve the performance suitable for the mixed-fleet application. For instance, and in some approaches, the lubricating compositions have an amount of magnesium from the detergent system that is greater than 500 ppm magnesium based on the lubricating composition, an amount of phosphorus from the antiwear and friction system that is less than 1200 ppm phosphorus based on the lubricating composition (preferably, less than 1000 ppm phosphorus, and even more preferably less than 800 ppm phosphorus), and an amount of metal (such as zinc) from the antiwear and friction system that is less than about 1000 ppm metal (such as zinc) based on the lubricating composition. In yet other embodiments, the lubricating compositions herein may also include calcium provided by the detergent system, but no more than about 1500 ppm of calcium and, in yet other optional embodiments, the fluids herein have a weight ratio of calcium to magnesium provided by the detergent system ranging from about 1.5:1 to about 4:1. The lubricating compositions with such characteristics surprisingly met the LSPI requirements for passenger cars and, at the same time, the friction performance requirements for heavy duty engine applications and, thus, permit the fluids herein to be so-called mixed-fleet capable fluids that can be used in either application depending on the desired use and circumstances.

The Detergent System

The lubricant compositions herein include a unique detergent system providing select amounts of magnesium and, in some embodiments, also select amounts of calcium delivered from detergent additives such as phenates and sulfonates and, in particular, calcium phenate and magnesium sulfonate and, optionally, calcium sulfonate (preferably low based to neutral calcium sulfonate if included). Suitable detergents and their methods of preparation are described in greater detail in numerous patent publications, including U.S. Pat. No. 7,732,390 and references cited therein, which are incorporated herein by reference. The lubricant compositions herein may include about 1 to about 5 weight percent, and in other approaches, about 1.5 to about 3 weight percent of the detergent system.

As noted above and in some approaches, the detergent system provides select amounts of magnesium, and in some approaches, also select amounts of calcium. For instance, the detergent system provides an amount of magnesium that is greater than about 500 ppm magnesium based on the total lubricating composition, and in other approaches, about 500 ppm to about 1000 ppm magnesium, about 600 ppm to about 800 ppm magnesium, or about 700 to about 800 ppm magnesium. At the same time, the fluids may also have a limited amount of calcium provided by the detergent system. In embodiments, the detergent system optionally provides no more than about 1500 ppm of calcium, no more than about 1400 ppm calcium, no more than about 1300 ppm calcium or about 900 to about 1500 ppm calcium or about 1000 ppm to about 1300 ppm. In approaches, the calcium and magnesium are provided by phenates and/or sulfonates and, preferably, the calcium is provided by a combination of phenates and optional sulfonates but the magnesium is provided by sulfonates.

In some approaches, a correct balance between the calcium and magnesium from the detergent system is one factor to aid in maintaining a mixed-fleet capable fluid because, if the balance is not set properly, then the fluid will not meet the dual performance benefits for spark ignition passenger cars as well as compression ignition heavy duty application to qualify for mixed fleet use. In some embodiments, the detergent system has a weight ratio of the calcium to magnesium provided by the detergent system of about 1.5:1 to about 4:1, about 1.6:1 to about 3:1, about 1.6:1 to about 2:1, or about 1.7:1 to about 2:1. The majority of the calcium may be provided by a calcium phenate with the remainder provided by an optional calcium sulfonate. The magnesium may be provided by a magnesium sulfonate. For instance, the detergent system may include about 50 to about 70 weight percent of the calcium phenate, about 30 to about 40 weight percent of the magnesium sulfonate, and about 0 to about 10 weight percent of the calcium sulfonate.

The detergent system may also include other optional detergents as needed for the circumstances so long as the weight ratio of magnesium and calcium discussed above are met. In general, detergent substrates may be salted with an alkali or alkaline earth metal such as, but not limited to, calcium and magnesium as discussed above, but other optional detergents may also be salted with potassium, sodium, lithium, barium, zinc, or mixtures thereof as long as the detergent system meets the calcium and magnesium requirements noted herein.

In one approach, suitable detergents in the system may include alkali or alkaline earth metal salts, e.g., calcium or magnesium, of petroleum sulfonic acids and long chain mono- or di-alkylaryl sulfonic acids with the aryl group being benzyl, tolyl, and xylyl and/or various phenates or derivatives of phenates. Examples of suitable detergents include, but are not limited to low-based/neutral and overbased variations of the following detergents: calcium phenates, calcium sulfur containing phenates, calcium sulfonates, calcium calixarates, calcium salixarates, calcium salicylates, calcium carboxylic acids, calcium phosphorus acids, calcium mono- and/or di-thiophosphoric acids, calcium alkyl phenols, calcium sulfur coupled alkyl phenol compounds, calcium methylene bridged phenols, magnesium phenates, magnesium sulfur containing phenates, magnesium sulfonates, magnesium calixarates, magnesium salixarates, magnesium salicylates, magnesium carboxylic acids, magnesium phosphorus acids, magnesium mono- and/or dithiophosphoric acids, magnesium alkyl phenols, magnesium sulfur coupled alkyl phenol compounds, magnesium methylene bridged phenols, sodium phenates, sodium sulfur containing phenates, sodium sulfonates, sodium calixarates, sodium salixarates, sodium salicylates, sodium carboxylic acids, sodium phosphorus acids, sodium mono- and/or dithiophosphoric acids, sodium alkyl phenols, sodium sulfur coupled alkyl phenol compounds, or sodium methylene bridged phenols.

The detergents may be also be neutral/low-based or overbased. Overbased detergent additives are well-known in the art and may be alkali or alkaline earth metal overbased detergent additives. Such detergent additives may be prepared by reacting a metal oxide or metal hydroxide with a substrate and carbon dioxide gas. The substrate is typically an acid, for example, an acid such as an aliphatic substituted sulfonic acid, an aliphatic substituted carboxylic acid, or an aliphatic substituted phenol.

The term "overbased" relates to metal salts, such as metal salts of sulfonates, carboxylates, salicylates and/or phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the MR is one and in an overbased salt, MR, is greater than one. They are commonly referred to as overbased, hyperbased, or superbased salts and may be salts of organic sulfur acids, carboxylic acids, or phenols.

As used herein, the term "TBN" is used to denote the Total Base Number in mg KOH/g as measured by the method of ASTM D2896. An overbased detergent of the lubricating oil composition may have a total base number (TBN) of about 200 mg KOH/gram or greater, or about 250 mg KOH/gram or greater, or about 350 mg KOH/gram or greater, or about 375 mg KOH/gram or greater, or about 400 mg KOH/gram or greater. The overbased detergent may have a metal to substrate ratio of from 1.1:1, or from 2:1, or from 4:1, or from 5:1, or from 7:1, or from 10:1.

Examples of suitable overbased detergents include, but are not limited to, overbased calcium phenates, overbased calcium sulfur containing phenates, overbased calcium sulfonates, overbased calcium calixarates, overbased calcium salixarates, overbased calcium salicylates, overbased calcium carboxylic acids, overbased calcium phosphorus acids, overbased calcium mono- and/or di-thiophosphoric acids, overbased calcium alkyl phenols, overbased calcium sulfur coupled alkyl phenol compounds, overbased calcium methylene bridged phenols, overbased magnesium phenates, overbased magnesium sulfur containing phenates, overbased magnesium sulfonates, overbased magnesium calixarates, overbased magnesium salixarates, overbased magnesium salicylates, overbased magnesium carboxylic acids, overbased magnesium phosphorus acids, overbased magnesium mono- and/or di-thiophosphoric acids, overbased magnesium alkyl phenols, overbased magnesium sulfur coupled alkyl phenol compounds, or overbased magnesium methylene bridged phenols.

When a low-based or neutral detergent is incorporated into the detergent system, it generally has a TBN of up to 175 mg KOH/g, up to 150 mg KOH/g, up to 100 mg KOH/g, or up to 50 mg KOH/g. The low-based/neutral detergent may include a calcium or magnesium-containing detergent. Examples of suitable low-based/neutral detergent include, but are not limited to, calcium sulfonates, calcium phenates, calcium salicylates, magnesium sulfonates, magnesium phenates, and/or magnesium salicylates.

In some embodiments, when the optional calcium sulfonate is incorporated into the detergent systems herein, it can be a neutral or low-base detergent and, in approaches, has a total base number of about 0 to about 100 and, in other approaches, about 0 to about 50. When a calcium phenate is incorporated into the detergent system, it can be an overbased detergent with a total base number of 150 to 400 and, in other approaches, about 200 to about 350. When a magnesium sulfonate is incorporated into the detergent system, it can be an overbased detergent with a total base number of 300 to 500 and, in other approaches, about 350 to about 450. In some approaches, the detergent systems and lubricants herein are also free of overbased calcium sulfonates or, free of calcium sulfonate additives with a TBN of 200 or more, and preferably, 300 or more. As used herein, "free of" generally means less than 0.5 weight percent, less than 0.1 weight percent, less than 0.05 weight percent, or none of a particular component. The above described TBN values reflect those of finished detergent components that have been diluted in a base oil.

In other embodiments, the TBN of a detergent may reflect a neat or non-diluted version of the detergent component. For example, calcium sulfonate as a neat (or non-diluted) additive may have a TBN of 0 to about 80, and in other approaches, about 20 to about 80. The calcium phenate as a neat additive may have a TBN of about 300 to about 450, and in other approaches, about 380 to about 420. The magnesium sulfonate as a neat additive may have a TBN of about 500 to about 700, and in other approaches, about 600 to about 700. In yet other embodiments, the detergent systems and lubricants herein may be free of overbased calcium sulfonate having a neat TBN of about 600 or greater.

The Antiwear and Friction System

The lubricating compositions herein also include an antiwear and friction system in combination with the detergent system discussed above. The antiwear and friction system provides a mixture of compounds containing metal and phosphorus effective to achieve, among other features, the friction performance. In embodiments, the lubricant compositions herein may include about 0.7 to about 2 weight percent, and in other approaches, about 0.9 to about 1.5 weight percent of the antiwear and friction system.

In approaches, the antiwear and friction system includes one or more, and in some approaches, a mixture of two or more metal dihydrocarbyl dithiophosphate compounds, such as but not limited to, zinc dihydrocarbyl dithiophosphate compound(s) (ZDDP). Suitable metal dithiophosphates, such as ZDDP, may include between 5 to about 12 weight percent metal (in other approaches, about 6 to about 10 weight percent metal where the metal is preferably zinc), and about 8 to about 20 weight percent sulfur (in other approaches, about 11 to about 19 weight percent sulfur). The metal dithiophosphates, such as ZDDP, may also include about 5 to about 10 weight percent phosphorus. Suitable metal dihydrocarbyl dithiophosphates may be any of the dihydrocarbyl dithiophosphate metal salts wherein the metal may be an alkali metal, alkaline earth metal, aluminum, lead, tin, molybdenum, manganese, nickel, copper, titanium, zirconium, zinc, or combinations thereof. However, the metal is preferably zinc.

When the phosphorus-containing compounds of the antiwear and friction system is a ZDDP, the alkyl groups on ZDDP may be derived from primary alcohols, secondary alcohols, and/or mixtures thereof. For example, primary alcohols suitable for forming the alkyl groups of the ZDDP include, but are not limited to, ethyl hexyl alcohol, 2-ethyl hexyl alcohol, butanol, isobutyl alcohol, amyl alcohol, and/or C6 and higher primary alcohols. Secondary alcohols suitable for forming the alkyl groups of the ZDDP include, but are not limited to, methyl isobutyl carbinol, isopropyl alcohol, or mixtures thereof. In some cases, the alkyl groups of the ZDDP may be derived from a mixture of primary and secondary alcohols, such as 2-ethyl hexanol (primary), isobutanol (primary), and isopropanol (secondary). For example and in one embodiment, one the ZDDP additives in the antiwear and friction system includes about 20% of alkyl groups derived from 2-ethyl hexanol, about 40% of alkyl groups derived from isobutanol, and about 40% of the alkyl groups derived from isopropanol. In other embodiments, a second ZDDP of the antiwear and friction system includes all alkyl groups derived from primary alcohols, such as a 2-ethyl hexanol or the like. In one approach, the antiwear and friction systems herein includes a mixture of metal dialkyl dithiophosphates (preferably zinc dialkyl dithiophosphates) derived from primary and secondary alcohols. In embodiments, a weight ratio of the primary to the secondary alcohols from the two ZDDP additives combined in the antiwear and friction system is at least 3:1 as discussed more below.

Examples of suitable ZDDPs include, but are not limited to: zinc O,O-di($C_{1-14}$-alkyl)dithiophosphate; zinc (mixed O,O-bis(sec-butyl and isooctyl)) dithiophosphate; zinc-O,O-bis(branched and linear $C_{3-8}$-alkyl)dithiophosphate; zinc O,O-bis(2-ethylhexyl)dithiophosphate; zinc O,O-bis(mixed isobutyl and pentyl)dithiophosphate; zinc mixed O,O-bis(1,3-dimethylbutyl and isopropyl)dithiophosphate; zinc O,O-diisooctyl dithiophosphate; zinc O,O-dibutyl dithiophosphate; zinc mixed O,O-bis(2-ethylhexyl and isobutyl and isopropyl)dithiophosphate; zinc O,O-bis(dodecylphenyl)dithiophosphate; zinc O,O-diisodecyl dithiophosphate; zinc O-(6-methylheptyl)-O-(1-methyl propyl)dithiophosphate; zinc O-(2-ethylhexyl)-O-(isobutyl) dithiophosphate; zinc O,O-diisopropyl dithiophosphate; zinc (mixed hexyl and isopropyl) dithiophosphate; zinc (mixed O-(2-ethylhexyl) and O-isopropyl) dithiophosphate; zinc O,O-dioctyl dithiophosphate; zinc O,O-dipentyl dithiophosphate; zinc O-(2-methylbutyl)-O-(2-methylpropyl)dithiophosphate; and zinc O-(3-methylbutyl)-O-(2-methylpropyl)dithiophosphate.

In yet other approaches, each of the phosphorus-containing compounds in the antiwear system herein may each have the structure of Formula I (Formula I)

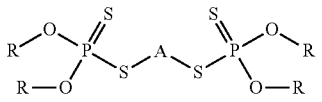

wherein R in Formula I independently contains from 1 to 18 carbon atoms, or 2 to 12 carbon atoms, or about 3 to 8 carbon atoms. The antiwear and friction system may contain two compounds of the structure of Formula I. In each compound, R may be ethyl, n-propyl, propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl as needed to meet the select ratio of primary to secondary alcohols noted above in the antiwear system. In some embodiment, the number of carbon atoms in each R group in Formula I above will generally be about 3 or greater, about 4 or greater, about 6 or greater, or about 8 or greater. Each R group may average 3 to 8 carbons. The total number of carbon atoms in the R groups may be 5 to about 72, or 12 to about 32. In Formula I, A is a metal, such as aluminum, lead, tin, molybdenum, manganese, nickel, copper, titanium, zirconium, zinc, or combinations thereof. Preferably, A is zinc.

In yet other approaches, the zinc dialkyl dithiophosphate of the antiwear and friction system have a sulfur-zinc coordination arrangement of the phosphorus compounds in the antiwear systems shown below the chemical structure of Formula II, which may used interchangeable with Formula I shown above. It is also understood that the structures shown in Formulas I and II may be present as monomer, dimer, trimer, or oligomer (such as a tetramer).

(Formula II)

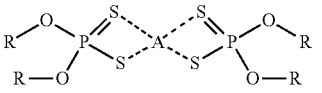

In some embodiments, each phosphorous-containing compound of the antiwear and friction system has the structure of Formula I wherein A is zinc and the combined total of the compounds within the antiwear and friction system provide about 600 to about 900 ppm phosphorus to the lubricant composition (and in other approaches, about 700 to about 800 ppm). In some instances, the antiwear and friction system includes a zinc dialkyl dithiophosphate derived from a mixture of primary and secondary alcohols. In other instances, the antiwear and friction system includes at least two zinc dialkyl dithiophosphates where a first zinc dialkyl dithiophosphate is derived only from primary alcohols and a second zinc dialkyl dithiophosphate is derived from a mixture of primary and secondary alcohols. Preferably, the antiwear and friction system includes one or more zinc dialkyl dithiophosphates, wherein a majority of the alkyl groups are derived from the primary alcohols, such as wherein a weight ratio of primary to secondary alcohols forming the ZDDPs within the antiwear and friction system (that is, all compounds of the antiwear mixture) is at least 3:1 (that is, about 75 to about 85% of all alkyl groups in the ZDDP(s) contained in the antiwear and friction system is from primary alcohols and about 15 to about 25% of alkyl groups is from a secondary alcohol). In other approaches, the ratio of primary to secondary alcohols forming the ZDDPs within the antiwear and friction system is at least about 4.1 or about 3:1 to about 5.5:1.

In other embodiments, the antiwear and friction and friction system may include up to about 60 weight percent of a first zinc dialkyl dithiophosphate derived only from primary alcohols and about 40 to about 50 weight percent of a second zinc dialkyl dithiophosphate derived from a mixture of primary and secondary alcohols. The second zinc dialkyl dithiophosphate may be derived from a mixture of primary and secondary alcohols including about 50 to about 70 weight percent primary alcohols and about 30 to about 50 weight percent secondary alcohols.

Commonly, lubricating compositions designed for compression ignition heavy duty application required up to 1200 ppm of phosphorus and in some instances about 1000 to about 1200 ppm phosphorus. The lubricating compositions herein, on the other hand, have no more 1200 ppm phosphorus, no more than 1000 ppm phosphorus, or even no more than 800 ppm phosphorus. In other approaches, the lubricating compositions herein include at least about 100 ppm phosphorus, at least about 200 ppm phosphorus, at least about 300 ppm phosphorus, at least about 400 ppm phosphorus, at least about 500 ppm phosphorus, at least about 600 ppm phosphorus, or even at least about 700 ppm phosphorus. Even with such low levels of phosphorus, however, the fluids herein surprisingly meet performance requirements described herein of both passenger car and compression ignition heavy duty engine applications.

Dihydrocarbyl dithiophosphate metal salts may be prepared in accordance with known techniques by first forming a dihydrocarbyl dithiophosphoric acid (DDPA), usually by reaction of one or more alcohols or phenols with P2S5 and then neutralizing the formed DDPA with a metal compound, such as zinc oxide. For example, DDPA may be made by reacting mixtures of primary and secondary alcohols with P2S5. In this case, the DDPA includes alkyl groups derived from both primary and secondary alcohols. Alternatively, multiple DDPAs can be prepared where the alkyl groups on one DDPA are derived entirely from secondary alcohols and the alkyl groups on another DDPA are derived entirely from primary alcohols. The DDPAs are then blended together to form a mixture of DDPAs having alkyl groups derived from both primary and secondary alcohols.

Base Oil

The base oil used in the lubricating oil compositions herein may be oils of lubricating viscosity and selected from any of the base oils in Groups I-V as specified in the American Petroleum Institute (API) Base Oil Interchangeability Guidelines. The five base oil groups are as follows:

TABLE 1

| Base oil Category | Sulfur (%) | | Saturates (%) | Viscosity Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | ≥120 |
| Group IV | All polyalphaolefins (PAOs) | | | |
| Group V | All others not included in Groups I, II, III, or IV | | | |

Groups I, II, and III are mineral oil process stocks. Group IV base oils contain true synthetic molecular species, which are produced by polymerization of olefinically unsaturated hydrocarbons. Many Group V base oils are also true synthetic products and may include diesters, polyol esters, polyalkylene glycols, alkylated aromatics, polyphosphate esters, polyvinyl ethers, and/or polyphenyl ethers, and the like, but may also be naturally occurring oils, such as vegetable oils. It should be noted that although Group III base oils are derived from mineral oil, the rigorous processing that these fluids undergo causes their physical properties to be very similar to some true synthetics, such as PAOs. Therefore, oils derived from Group III base oils may be referred to as synthetic fluids in the industry. Group II+ may comprise high viscosity index Group II.

The base oil or base oil blend used in the disclosed lubricating oil composition may be a mineral oil, animal oil, vegetable oil, synthetic oil, synthetic oil blends, or mixtures thereof. Suitable oils may be derived from hydrocracking, hydrogenation, hydrofinishing, unrefined, refined, and re-refined oils, and mixtures thereof.

Unrefined oils are those derived from a natural, mineral, or synthetic source without or with little further purification treatment. Refined oils are similar to the unrefined oils except that they have been treated in one or more purification steps, which may result in the improvement of one or more properties. Examples of suitable purification techniques are solvent extraction, secondary distillation, acid or base extraction, filtration, percolation, and the like. Oils refined to the quality of an edible may or may not be useful. Edible oils may also be called white oils. In some embodiments, lubricating oil compositions are free of edible or white oils.

Re-refined oils are also known as reclaimed or reprocessed oils. These oils are obtained similarly to refined oils using the same or similar processes. Often these oils are additionally processed by techniques directed to removal of spent additives and oil breakdown products.

Mineral oils may include oils obtained by drilling or from plants and animals or any mixtures thereof. For example such oils may include, but are not limited to, castor oil, lard oil, olive oil, peanut oil, corn oil, soybean oil, and linseed oil, as well as mineral lubricating oils, such as liquid petroleum oils and solvent-treated or acid-treated mineral lubricating oils of the paraffinic, naphthenic or mixed paraffinic-naphthenic types. Such oils may be partially or fully hydrogenated, if desired. Oils derived from coal or shale may also be useful.

Useful synthetic lubricating oils may include hydrocarbon oils such as polymerized, oligomerized, or interpolymerized olefins (e.g., polybutylenes, polypropylenes, propyleneisobutylene copolymers); poly(1-hexenes), poly(1-octenes), trimers or oligomers of 1-decene, e.g., poly(1-decenes), such materials being often referred to as α-olefins, and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof. Polyalphaolefins are typically hydrogenated materials.

Other synthetic lubricating oils include polyol esters, diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

The major amount of base oil included in a lubricating composition may be selected from the group consisting of Group I, Group II, a Group III, a Group IV, a Group V, and a combination of two or more of the foregoing, and wherein the major amount of base oil is other than base oils that arise from provision of additive components or viscosity index improvers in the composition. In another embodiment, the major amount of base oil included in a lubricating composition may be selected from the group consisting of Group II, a Group III, a Group IV, a Group V, and a combination of two or more of the foregoing, and wherein the major amount of base oil is other than base oils that arise from provision of additive components or viscosity index improvers in the composition.

The amount of the oil of lubricating viscosity present may be the balance remaining after subtracting from 100 wt % the sum of the amount of the performance additives inclusive of viscosity index improver(s) and/or pour point depressant(s) and/or other top treat additives. For example, the oil of lubricating viscosity that may be present in a finished fluid may be a major amount, such as greater than about 50 wt %, greater than about 60 wt %, greater than about 70 wt %, greater than about 80 wt %, greater than about 85 wt %, or greater than about 90 wt %.

Optional Additives

The lubricating compositions described herein may also include other additives in addition to the detergent system and antiwear system components described above. Such additives include, but are not limited to, antioxidant(s), viscosity modifier(s), other phosphorus-containing components, other detergent(s), corrosion inhibitor(s), antirust additives, antifoam agent(s), demulsifier(s), pour point depressant(s), seal swell agent(s), additional dispersant(s), friction modifier(s), and/or additional sulfur-containing component(s) so long as the other additives do not impact the compositional features and relationships as discussed above suitable for the fluids to be mixed fleet capable.

Antioxidants

Antioxidants reduce the tendency of base stocks to deteriorate in service. Such deterioration can be evidenced by the products of oxidation such as sludge and varnish that deposit on metal surfaces. Such antioxidants include hindered phenols, aromatic amine antioxidants, and sulfur-containing antioxidants.

Examples of phenolic antioxidants include 2,6-di-tert-butylphenol, liquid mixtures of tertiary butylated phenols, 2,6-di-tert-butyl-4-methylphenol, 4,4'-methylenebis(2,6-di-tert-butylphenol), 2,2'-methylenebis(4-methyl-6-ter-t-butylphenol), and mixed methylene-bridged polyalkyl phenols, and 4,4'-thiobis(2-methyl-6-tert-butylphenol), N,N'-di-sec-butyl-phenylenediamine, 4-iisopropylamino diphenylamine, phenyl-alpha-naphthyl amine, phenyl-alpha-naphthyl amine, and ring-alkylated diphenylamines. Examples include the sterically hindered tertiary butylated phenols, bisphenols and cinnamic acid derivatives and combinations thereof.

Aromatic amine antioxidants include, but are not limited to diarylamines having the formula:

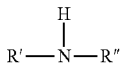

wherein R' and R" each independently represents a substituted or unsubstituted aryl group having from 6 to 30 carbon atoms. Illustrative of substituents for the aryl group include aliphatic hydrocarbon groups such as alkyl having from 1 to 30 carbon atoms, hydroxy groups, halogen radicals, carboxylic acid or ester groups, or nitro groups.

The aryl group is preferably substituted or unsubstituted phenyl or naphthyl, particularly wherein one or both of the aryl groups are substituted with at least one alkyl having from 4 to 30 carbon atoms, preferably from 4 to 18 carbon atoms, most preferably from 4 to 9 carbon atoms. It is preferred that one or both aryl groups be substituted, e.g. mono-alkylated diphenylamine, di-alkylated diphenylamine, or mixtures of mono- and di-alkylated diphenylamines.

Examples of diarylamines that may be used include, but are not limited to: diphenylamine; various alkylated diphenylamines, 3-hydroxydiphenylamine, N-phenyl-1,2-phenylenediamine, N-phenyl-1,4-phenylenediamine, monobutyldiphenyl-amine, dibutyldiphenylamine, monooctyldiphenylamine, dioctyldiphenylamine, monononyldiphenylamine, dinonyldiphenylamine, monotetradecyldiphenylamine, ditetradecyldiphenylamine, phenyl-alpha-naphthylamine, monooctyl phenyl-alpha-naphthylamine, phenyl-beta-naphthylamine, monoheptyldiphenylamine, diheptyl-diphenyl amine, p-oriented styrenated diphenylamine, mixed butyloctyldi-phenylamine, and mixed octylstyryldiphenylamine.

The sulfur containing antioxidants include, but are not limited to, sulfurized hindered phenols, sulfurized olefins, metal thiocarbamates, and ashless dialkyl dithiocarbamates. Sulfurized olefins are characterized by the type of olefin used in their production and the final sulfur content of the antioxidant. High molecular weight olefins, i.e. those olefins having an average molecular weight of 168 to 351 g/mole, are preferred. Examples of olefins that may be used include alpha-olefins, isomerized alpha-olefins, branched olefins, cyclic olefins, and combinations of these.

Alpha-olefins include, but are not limited to, any C4 to C25 alpha-olefins. Alpha-olefins may be isomerized before the sulfurization reaction or during the sulfurization reaction. Structural and/or conformational isomers of the alpha olefin that contain internal double bonds and/or branching may also be used. For example, isobutylene is a branched olefin counterpart of the alpha-olefin 1-butene.

Sulfur sources that may be used in the sulfurization reaction of olefins include: elemental sulfur, sulfur monochloride, sulfur dichloride, sodium sulfide, sodium polysulfide, and mixtures of these added together or at different stages of the sulfurization process.

Unsaturated oils, because of their unsaturation, may also be sulfurized and used as an antioxidant. Examples of oils or fats that may be used include corn oil, canola oil, cottonseed oil, grapeseed oil, olive oil, palm oil, peanut oil, coconut oil, rapeseed oil, safflower seed oil, sesame seed oil, soybean oil, sunflower seed oil, tallow, and combinations of these.

The ashless dialkyldithiocarbamates which may be used as antioxidant additives include compounds that are soluble or dispersable in the additive package. It is also preferred that the ashless dialkyldithiocarbmate be of low volatility, preferably having a molecular weight great than 250 daltons, most preferably having a molecular weight greater than 400 daltons. Example of dialkyldithiocarbamates that may be used are disclosed in the following patents U.S. Pat. Nos. 5,693,598; 4,876,375; 4,927,552; 4,957,643; 4,885,365; 5,789,357; 5,686,397; 5,902,776; 2,786,866; 2,710,872; 2,384,577; 2,897,152; 3,407,222; 3,867,359; and 4,758,362.

The total amount of antioxidant in the lubricating compositions herein may be present in an amount to deliver up to about 200 ppm nitrogen, or up to about 100 ppm nitrogen, or up to about 150 ppm nitrogen, or about 100 to about 150 ppm nitrogen.

Friction Modifiers

In some embodiments, the lubricating compositions herein may contains friction modifiers. Suitable additional friction modifiers may comprise metal containing and metal-free friction modifiers and may include, but are not limited to, imidazolines, amides, amines, succinimides, alkoxylated amines, alkoxylated ether amines, amine oxides, amidoamines, nitriles, betaines, quaternary amines, imines, amine salts, amino guanidine, alkanolamides, phosphonates, metal-containing compounds, glycerol esters, sulfurized fatty compounds and olefins, sunflower oil other naturally occurring plant or animal oils, dicarboxylic acid esters, esters or partial esters of a polyol and one or more aliphatic or aromatic carboxylic acids, and the like.

Suitable friction modifiers may contain hydrocarbyl groups that are selected from straight chain, branched chain, or aromatic hydrocarbyl groups or mixtures thereof, and such hydrocarbyl groups may be saturated or unsaturated. The hydrocarbyl groups may be composed of carbon and hydrogen or hetero atoms such as sulfur or oxygen. The hydrocarbyl groups may range from 12 to 25 carbon atoms. In some embodiments the friction modifier may be a long chain fatty acid ester. In another embodiment the long chain fatty acid ester may be a mono-ester, or a di-ester, or a (tri)glyceride. The friction modifier may be a long chain fatty amide, a long chain fatty ester, a long chain fatty epoxide derivative, or a long chain imidazoline.

Other suitable friction modifiers may include organic, ashless (metal-free), nitrogen-free organic friction modifiers. Such friction modifiers may include esters formed by reacting carboxylic acids and anhydrides with alkanols and generally include a polar terminal group (e.g. carboxyl or hydroxyl) covalently bonded to an oleophilic hydrocarbon chain. An example of an organic ashless nitrogen-free friction modifier is known generally as glycerol monooleate (GMO) which may contain mono-, di-, and tri-esters of oleic acid. Other suitable friction modifiers are described in U.S. Pat. No. 6,723,685.

Aminic friction modifiers may include amines or polyamines. Such compounds can have hydrocarbyl groups that are linear, either saturated or unsaturated, or a mixture thereof and may contain from 12 to 25 carbon atoms. Further examples of suitable friction modifiers include alkoxylated amines and alkoxylated ether amines. Such compounds may have hydrocarbyl groups that are linear, either saturated, unsaturated, or a mixture thereof. They may contain from about 12 to about 25 carbon atoms. Examples include ethoxylated amines and ethoxylated ether amines.

The amines and amides may be used as such or in the form of an adduct or reaction product with a boron compound such as a boric oxide, boron halide, metaborate, boric acid or a mono-, di- or tri-alkyl borate. Other suitable friction modifiers are described in U.S. Pat. No. 6,300,291.

If friction modifiers contain nitrogen, such friction modifiers may be present in the lubricating compositions herein in an amount to deliver up to about 200 ppm nitrogen, or up to about 150 ppm nitrogen, or about 100 to about 150 ppm nitrogen.

Corrosion Inhibitors

Rust or corrosion inhibitors may also be included in the lubricating compositions described herein. Such materials include monocarboxylic acids and polycarboxylic acids. Examples of suitable monocarboxylic acids are octanoic acid, decanoic acid and dodecanoic acid. Suitable polycarboxylic acids include dimer and trimer acids such as are produced from such acids as tall oil fatty acids, oleic acid, linoleic acid, or the like.

Another useful type of rust inhibitor may be alkenyl succinic acid and alkenyl succinic anhydride corrosion inhibitors such as, for example, tetrapropenylsuccinic acid, tetrapropenylsuccinic anhydride, tetradecenylsuccinic acid, tetradecenylsuccinic anhydride, hexadecenylsuccinic acid, hexadecenylsuccinic anhydride, and the like. Also useful are the half esters of alkenyl succinic acids having 8 to 24 carbon atoms in the alkenyl group with alcohols such as the polyglycols. Other suitable rust or corrosion inhibitors include ether amines, acid phosphates, amines, polyethoxylated compounds such as ethoxylated amines, ethoxylated phenols, and ethoxylated alcohols, imidazolines, aminosuccinic acids or derivatives thereof, and the like. Mixtures of such rust or corrosion inhibitors may be used. The total amount of corrosion inhibitor, when present in the lubricating compositions described herein may range up to 2.0 wt % or from 0.01 to 1.0 wt % based on the total weight of the lubricating composition.

Viscosity Modifiers

The lubricating compositions herein may optionally contain one or more viscosity modifiers and, if included within the fluids, the viscosity modifiers may preferably be olefin copolymer viscosity modifiers as discussed more below, and/or the compositions may contain about 4 to about 10, about or about 6 to about 9 weight percent.

Suitable viscosity modifiers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity modifiers may include star polymers and suitable examples are described in US Publication No. 2012/0101017 A1.

The lubricating compositions described herein also may optionally contain one or more dispersant viscosity modifiers in addition to a viscosity modifier or in lieu of a viscosity modifier. Suitable dispersant viscosity modifiers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

Demulsifiers

Demulsifiers include trialkyl phosphates, and various polymers and copolymers of ethylene glycol, ethylene oxide, propylene oxide, or mixtures thereof, including polyethylene oxides, polypropylene oxides and (ethylene oxide-propylene oxide) polymers. When present, the amount of demulsifier in the lubricating compositions herein may be up about 0.05 wt, or up to about 0.02 wt %, or below about 0.015 wt % based on the total weight of the lubricating and cooling fluid.

Antifoam Agents

Antifoam agents used to reduce or prevent the formation of stable foam include silicones, polyacrylates, or organic polymers. Foam inhibitors that may be useful in the compositions of the disclosed invention include polysiloxanes, copolymers of ethyl acrylate and 2-ethylhexylacrylate and optionally vinyl acetate. When present, the amount of antifoam in the lubricating compositions herein may be up about 0.1 wt, or up to about 0.08 wt %, or below about 0.07 wt % based on the total weight of the lubricating and cooling fluid.

Pour Point Depressants

The lubricating and cooling fluid may optionally contain one or more pour point depressants. Suitable pour point depressants may include esters of maleic anhydride-styrene, polymethacrylates, polymethylmethacrylates, polyacrylates or polyacrylamides or mixtures thereof. Pour point depressants, when present, may be present in amount from about 0.001 wt % to about 0.04 wt %, based upon the total weight of the lubricating and cooling fluid.

Molybdenum-Containing Compounds

The lubricating oil compositions herein also may optionally contain one or more molybdenum-containing compounds. An oil-soluble molybdenum compound may have the functional performance of an antiwear agent, an antioxidant, a friction modifier, or mixtures thereof.

Exemplary molybdenum-containing components may include molybdenum dithiocarbamates, molybdenum dialkyldithio-phosphates, molybdenum dithiophosphinates, amine salts of molybdenum compounds, molybdenum xanthates, molybdenum thioxanthates, molybdenum sulfides, molybdenum carboxylates, molybdenum alkoxides, a trinuclearorgano-molybdenum compound, and/or mixtures thereof. Alternatively, an oil-soluble molybdenum compound may include molybdenum dithiocarbamates, molybdenum dialkyldithiophosphates, molybdenum dithiophosphinates, amine salts of molybdenum compounds, molybdenum xanthates, molybdenum thioxanthates, molybdenum sulfides, molybdenum carboxylates, molybdenum alkoxides, a trinuclear organo-molybdenum compound, and/or mixtures thereof. The molybdenum sulfides include molybdenum disulfide. The molybdenum disulfide may be in the form of a stable dispersion. In one embodiment the oil-soluble molybdenum compound may be selected from the group consisting of molybdenum dithiocarbamates, molybdenum dialkyldithiophosphates, amine salts of molybdenum compounds, and mixtures thereof. In one embodiment the oil-soluble molybdenum compound may be a molybdenum dithiocarbamate.

Suitable examples of molybdenum compounds which may be used include commercial materials sold under the trade names such as Molyvan® 822, Molyvan® A, Molyvan® 2000 and Molyvan® 855 from R. T. Vanderbilt Co., Ltd., and Sakura-Lube™ S-165, S-200, S-300, 5-310G, S-525, S-600, S-700, and S-710 available from Adeka Corporation, and mixtures thereof. Suitable molybdenum components are described in U.S. Pat. No. 5,650,381; U.S.

Pat. No. RE 37,363 E1; U.S. Pat. No. RE 38,929 E1; and U.S. Pat. No. RE 40,595 E1, incorporated herein by reference in their entireties.

Additionally, the molybdenum compound may be an acidic molybdenum compound. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds. Alternatively, the compositions can be provided with molybdenum by molybdenum/sulfur complexes of basic nitrogen compounds as described, for example, in U.S. Pat. Nos. 4,263,152; 4,285,822; 4,283,295; 4,272,387; 4,265,773; 4,261,843; 4,259,195 and 4,259,194; and WO 94/06897, incorporated herein by reference in their entireties.

Another class of suitable organo-molybdenum compounds are trinuclear molybdenum compounds, such as those of the formula $Mo_3S_kL_nQ_z$ and mixtures thereof, wherein S represents sulfur, L represents independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms may be present among all the ligands' organo groups, such as at least 25, at least 30, or at least 35 carbon atoms. Additional suitable molybdenum compounds are described in U.S. Pat. No. 6,723,685, herein incorporated by reference in its entirety.

If included, the oil-soluble molybdenum compound may be present in an amount sufficient to provide about 10 ppm to about 1000 ppm, about 20 ppm to about 700 ppm, about 20 ppm to about 550 ppm, about 20 ppm to about 300 ppm, or about 20 ppm to about 150 ppm of molybdenum.

In general terms, the mixed fleet lubricating compositions described herein may include additive components in the ranges listed in Table 2 below.

TABLE 2

| Finished Oil Formulation | | |
|---|---|---|
| Component | Wt. % (Suitable Embodiments) | Wt. % (Preferred Embodiments) |
| Detergent system | 1-5 | 1-3 |
| Antiwear and Friction System | 0.5-1.5 | 0.75-1.25 |
| Antioxidant(s) | 1-4 | 2-3 |
| Corrosion inhibitor(s) | 0-5 | 0-2 |
| Antifoaming agent(s) | 0-2 | 0-1 |
| Pour point depressant(s) | 0-1 | 0-0.5 |
| Viscosity index improver(s) | 0-10 | 2-8 |
| Friction modifier(s) | 0-2 | 0.1-1 |
| Dispersant(s) | 3-15 | 5-10 |
| Base oil(s) | Balance | Balance |
| Total | 100 | 100 |

The percentages of each component above represent the weight percent of each component, based upon the weight of the total final lubricating oil composition. The balance of the lubricating oil composition consists of one or more base oils. Additives used in formulating the compositions described herein may be blended into the base oil individually or in various sub-combinations. However, it may be suitable to blend all of the components concurrently using an additive concentrate (i.e., additives plus a diluent, such as a hydrocarbon solvent).

Fully formulated lubricants conventionally contain an additive package, often referred to as a dispersant/inhibitor package or DI package typically supplies certain performance and/or characteristics that are required in the formulations. Suitable DI packages are described for example in U.S. Pat. Nos. 5,204,012 and 6,034,040 for example. Among the types of additives included in the additive package may be dispersants, seal swell agents, antioxidants, foam inhibitors, lubricity agents, rust inhibitors, corrosion inhibitors, demulsifiers, viscosity index improvers, and the like. Several of these components are well known to those skilled in the art and are generally used in conventional amounts with the additives and compositions described herein.

Lubricants, combinations of components, or individual components of the present description may be suitable for use as a lubricant in various types of internal combustion engines. Suitable engine types may include, but are not limited to, heavy duty diesel, passenger car, light duty diesel, medium speed diesel, or marine engines. An internal combustion engine may be a diesel fueled engine, a gasoline fueled engine, a natural gas fueled engine, a bio-fueled engine, a mixed diesel/biofuel fueled engine, a mixed gasoline/biofuel fueled engine, an alcohol fueled engine, a mixed gasoline/alcohol fueled engine, a compressed natural gas (CNG) fueled engine, or mixtures thereof. A diesel engine may be a compression ignited engine. A gasoline engine may be a spark-ignited engine. An internal combustion engine may also be used in combination with an electrical or battery source of power. An engine so configured is commonly known as a hybrid engine. The internal combustion engine may be a 2-stroke, 4-stroke, or rotary engine. Suitable internal combustion engines include marine diesel engines (such as inland marine), aviation piston engines, low-load diesel engines, and motorcycle, automobile, locomotive, and truck engines.

The lubricating oil composition for an internal combustion engine may be suitable for any engine lubricant irrespective of the sulfur, phosphorus, or sulfated ash (ASTM D-874) content. In some approaches, the sulfur content of the engine oil lubricants herein may be about 1 weight percent or less, or about 0.8 weight percent or less, or about 0.5 weight percent or less, or about 0.3 weight percent or less, or about 0.2 weight percent or less. In one embodiment the sulfur content may be in the range of about 0.001 weight percent to about 0.5 weight percent, or about 0.01 weight percent to about 0.3 weight percent. The total sulfated ash content of the engine oil lubricants herein may be about 2 weight percent or less, or about 1.5 weight percent or less, or about 1.1 weight percent or less, or about 1 weight percent or less, or about 0.8 weight percent or less, or about 0.5 weight percent or less. In one embodiment the sulfated ash content may be about 0.1 weight percent to about 0.9 weight percent, or about 0.1 weight percent or about 0.2 weight percent to about 0.8 weight percent.

Further, lubricants of the present description may be suitable to meet one or more industry specification requirements such as ILSAC GF-3, GF-4, GF-5, GF-6, CK-4, FA-4, CJ-4, CI-4 Plus, CI-4, ACEA A1/B1, A2/B2, A3/B3, A3/B4, A5/B5, A7/B7, C1, C2, C3, C4, C5, C6, E4/E6/E7/E9, Euro 5/6, JASO DL-1, Low SAPS, Mid SAPS, or original equipment manufacturer specifications such as Dexos™ 1, Dexos™ 2, MB-Approval 229.51/229.31, VW 502.00, 503.00/503.01, 504.00, 505.00, 506.00/506.01, 507.00, 508.00, 509.00, BMW Longlife-04, Porsche C30, Peugeot Citroen Automobiles B71 2290, B71 2296, B71 2297, B71 2300, B71 2302, B71 2312, B71 2007, B71 2008, Ford WSS-M2C153-H, WSS-M2C930-A, WSS-M2C945-A, WSS-M2C913A, WSS-M2C913-B, WSS-M2C913-C, GM 6094-M, Chrysler MS-6395, or any past or future passenger car motor oil or heavy duty diesel oil specifications not mentioned herein. In some embodiments for passenger car motor oil applications, the amount of phosphorus in the finished fluid is surprisingly only about 800 ppm or less or 600 ppm or less. In some embodiments for heavy duty diesel applications, the amount of phosphorus in the finished fluid is also surprisingly about 800 ppm or less.

In certain applications, the lubricants of the present disclosure may also be suitable for automatic transmission fluids, continuously variable transmission fluids, manual transmission fluids, gear oils, other fluids related to power train components, off-road fluids, power steering fluids, fluids used in wind turbines, compressors, hydraulic fluids, slideway fluids, and other industrial fluids. In certain applications, these lubricating applications may include lubrication of gearboxes, power take-off and clutch(es), rear axles, reduction gears, wet brakes, and hydraulic accessories.

EXAMPLES

The following examples are illustrative of exemplary embodiments of the disclosure. In these examples, as well as elsewhere in this application, all ratios, parts, and percentages are by weight unless otherwise indicated. It is intended that these examples are being presented for the purpose of illustration only and are not intended to limit the scope of the invention disclosed herein.

Comparative Example 1

Comparative Lubricating Compositions C-1, C-2, and C-3 were subjected to an Allison Friction test TES-439 (November 2010 release available from Allison Transmission) and Sequence IX low-speed pre-ignition (LSPI) test of modified ASTM D8291-21a. The LSPI test was slightly modified such that only two iterations were reported. Table 3 below shows the detergent system and the antiwear and friction systems included in the Comparative Lubricating Compositions, which were formulated with a Group II base oil as 15W-40 fluid using the same amounts of other additives including dispersants, antioxidants, organo-molybdenum additive, antifoam, ashless antiwear additives, olefin copolymer viscosity modifier, and base oil blend. Allison Friction and LSPI performance results are provided in Tables 4 and 5. Pass/Fail criteria are set forth in the TES test guidelines and as pursuant to the set of friction plates received from Allison Transmission and/or provided in the above-noted ASTM test guidelines.

TABLE 3

Comparative Lubricating Compositions

| Component<br>Base Oil | Lubricating Composition<br>C-1<br>Group II | C-2<br>Group II | C-3<br>Group II |
|---|---|---|---|
| Detergent System | | | |
| Calcium Phenate | 1.36% | 1.36% | 1.36% |
| Calcium sulfonate 1 | 0.89% | — | 0.89% |
| Magnesium Sulfonate | — | 0.75% | — |
| Calcium sulfonate 2 | — | 0.05% | — |

TABLE 3-continued

Comparative Lubricating Compositions

| Component<br>Base Oil | Lubricating Composition<br>C-1<br>Group II | C-2<br>Group II | C-3<br>Group II |
|---|---|---|---|
| Calcium from Detergent System | 2317 ppm | 1271 ppm | 2317 ppm |
| Magnesium from Detergent System | 0 | 720 ppm | 0 |
| Antiwear System | | | |
| ZDDP A | 0.94% | 0.94% | 0.46% |
| ZDDP B | — | — | 0.53% |
| Ratio of Primary to Secondary Alcohol | 1.5:1 | 1.5:1 | 4.2:1 |
| Zinc from Antiwear System | 865 ppm | 865 ppm | 788 ppm |
| Phosphorus from Antiwear System | 785 ppm | 785 ppm | 710 ppm |

In the detergent system of Table 3, the calcium phenate had a TBN of 250 and 9.3 weight percent calcium (a neat TBN of 413), the calcium sulfonate 1 had a TBN of 300 and 11.9 weight percent calcium (a neat TBN of 605), the magnesium sulfonate had a TBN of 400 and 9.6 weight percent magnesium (a neat TBN of 680), and the calcium sulfonate 2 had TBN of 28 and 2.6 weight percent calcium (a neat TBN of 69). In the antiwear and friction system, ZDDP A was a zinc dialkyldithiophosphate and included mixed alkyl groups with about 40% of the alkyl groups being C3 and derived from a secondary alcohol (isopropanol), about 40% of the alkyl groups being C4 and derived from a primary alcohol (isobutanol), and about 20% of the alkyl groups being C8 and derived from a primary alcohol (2-ethylhexanol). ZDDP A contained about 8.4 wt % phosphorus, 17.8 wt % sulfur, and about 9.2 wt % zinc. The ZDDP B used in this Example was a zinc dialkyldithiophosphate with 100% of the alkyl groups being C8 and derived from a primary alcohol (2-ethylhexanol). ZDDP B contained about 6.1 wt % phosphorus, about 12.7 wt % sulfur, and about 6.75 wt % zinc.

TABLE 4

Allison Friction*

| | | C-1<br>PASS | C-2<br>FAIL | C-3<br>PASS |
|---|---|---|---|---|
| Slip Time | Result | 0.89 | 0.98 | 0.80 |
| | % change from initial | 4.71% | 24.05% | 1.23% |
| Friction Coefficient (midpoint) | Result | 0.08 | 0.07 | 0.097 |
| | % change from initial | −5.88% | −27.84% | 2.11% |

*Note:
pass/fail criteria is based on Min and Max values of slip time and friction coefficient as provided by Allison Transmission when supplying the particular friction plates.

TABLE 5

Sequence IX LSPI

| LSPI Events | C-1 | C-2 | C-3 |
|---|---|---|---|
| A | 11 | 1 | 19 |
| B | 15 | 2 | 11 |
| Total | 26 | 3 | 30 |
| Average Final Original Unit Result | 11.93 | 0.57 | 13.85 |
| Allowed Maximum | 13.85 | 0.95 | 17.71 |
| Pass/Fail | FAIL | PASS | FAIL |

As shown in Tables 4 and 5, neither comparative lubricants C-1, C-2, nor C-3 could pass both the sequence IX LSPI requirements for passenger car motor oils and the Allison friction requirements for heavy duty engine applications. While fluid C-1 and C-3 passed the Allison Friction tests, these fluids failed LSPI testing. Fluid C-2 included magnesium from the detergent and had good LSPI performance, but failed Allison Friction performance. Thus, none of Comparative Lubricating Compositions C1, C2, or C3 is mixed fleet capable for both compression ignition heavy duty and spark ignition passenger car applications.

Example 1

Inventive lubricating compositions consistent with the present disclosure were evaluated for LSPI and Allison friction. Table 6 below shows the detergent and antiwear and friction systems included in the inventive fluids, which were also formulated as 15W-40 fluid using the same amounts of other additives used in the Comparative Fluids of Comparative Example 1 including dispersants, antioxidants, organomolybdenum additive, antifoam, ashless antiwear additives, olefin copolymer viscosity modifier, and base oil blend. Inventive Composition I-1 used a Group III base oil and Inventive Composition 1-2 used a Group II base oil to achieve the finished fluids; otherwise, the remaining additives and amounts were the same as those in Comparative Example 1. LSPI and Allison friction testing results are shown below in Tables 7 and 8.

TABLE 6

Inventive Lubricating Compositions

| Component | Lubricating Composition | |
|---|---|---|
| | I-1 | I-2 |
| Base Oil | Group III | Group II |
| Detergent System | | |
| Calcium Phenate | 1.36% | 1.36% |
| Calcium sulfonate 1 | — | — |
| Magnesium Sulfonate | 0.75% | 0.75% |
| Calcium sulfonate 2 | 0.05% | — |
| Calcium from Detergent System | 1271 ppm | 1258 ppm |
| Magnesium from Detergent System | 711 ppm | 711 ppm |
| Calcium to Magnesium Ratio | 1.78:1 | 1.78:1 |
| AntiWear System | | |
| ZDDP A | 0.46% | 0.46% |
| ZDDP B | 0.53% | 0.53% |
| Ratio of Primary to Secondary Alcohol | 4.2:1 | 4.2:1 |
| Zinc from Antiwear System | 788 ppm | 788 ppm |
| Phosphorus from Antiwear System | 710 ppm | 710 ppm |

In the detergent system of Table 6, the additives were the same as those in Comparative Example 1. In the antiwear and friction system, ZDDP A was the also same as that used in Comparative Examples 1-3 and the ZDDP B was the same as that used in Comparative Example 3. Performance testing is below in Tables 7 and 8.

TABLE 7

Allison Friction*

| | | I-1 PASS | I-2 PASS |
|---|---|---|---|
| Slip Time | Result | 0.82 | 0.79 |
| | % change from initial | −3.53% | 0.00% |

TABLE 7-continued

Allison Friction*

| | | I-1 PASS | I-2 PASS |
|---|---|---|---|
| Friction (midpoint) Coefficient | Result | 0.095 | 0.01 |
| | % change from initial | 3.26% | −0.99% |

*Note:
pass/fail criteria is based on Min and Max values of slip time and friction coefficient as provided by Allison Transmission when supplying the particular friction plates.

TABLE 8

Sequence IX LSPI

| LSPI Events | I-1 | I-2 |
|---|---|---|
| A | 2 | 1 |
| B | 5 | 8 |
| Total | 7 | 9 |
| Average Final Original Unit Result | 3.14 | 4.09 |
| Allowed Maximum | 4.57 | 7.47 |
| Pass/Fail | PASS | PASS |

As shown in Tables 7 and 8 above, inventive lubricating compositions I-1 and 1-2 passed both the LSPI performance testing for spark ignition passenger car motor oils and also the Allison friction testing for compression ignition heavy duty engine applications. These compositions includes the unique detergent system and antiwear and friction system as described herein. Thus, lubricating compositions I-1 and 1-2 were both suitable for mixed fleet applications or use.

In embodiments herein, the lubricating compositions exhibit no more than 5 average events pursuant to a Sequence IX low speed pre-ignition test pursuant to ASTM D8291-21a when using two iterations; the lubricating compositions have an absolute value percent change from initial slip time of about 10 percent or less pursuant to Allison Transmission friction test TES-439 (November 2010) (preferably, 5 percent or less, or even 2 percent or less); and an absolute value percent change from initial friction coefficient (midpoint) of 10 percent or less pursuant to Allison Transmission friction test TES-439 (November 2010) (preferably, 5 percent or less, or even 2 percent or less).

Unless specified otherwise in the above examples, the amounts of calcium, magnesium, phosphorus, and zinc are calculated based on the treat rates and amounts of each element provided by the individual additive.

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is to be understood that each component, compound, substituent or parameter disclosed herein is to be interpreted as being disclosed for use alone or in combination with one or more of each and every other component, compound, substituent or parameter disclosed herein.

It is further understood that each range disclosed herein is to be interpreted as a disclosure of each specific value within the disclosed range that has the same number of significant digits. Thus, for example, a range from 1 to 4 is to be interpreted as an express disclosure of the values 1, 2, 3 and 4 as well as any range of such values.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range. That is, it is also further understood that any range between the endpoint values within the broad range is also discussed herein. Thus, a range from 1 to 4 also means a range from 1 to 3, 1 to 2, 2 to 4, 2 to 3, and so forth.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A lubricating composition suitable for diesel and gasoline engines, the lubricating composition comprising:

a detergent system providing both calcium and magnesium from one or more of a sulfonate, a phenate, a salicylate, or mixtures thereof and wherein a weight ratio of the calcium-to-magnesium provided by the detergent system is about 1.5:1 to about 2:1; and an antiwear and friction system including two or more metal dialkyl dithiophosphates derived from primary and secondary alcohols, wherein a first metal dialkyl dithiophosphate is derived from primary alcohols and a second metal dialkyl dithiophosphate is derived from a mixture of primary and secondary alcohols, and wherein a weight ratio of primary to secondary alcohols from the two or more metal dialkyl dithiophosphates combined in the antiwear and friction system is at least about 3:1 to about 5.5:1;

wherein the amount of magnesium from the detergent system is at least 500 ppm magnesium based on the lubricating composition; and wherein the amount of phosphorus from the antiwear and friction system is less than 1200 ppm phosphorus based on the lubricating composition and the amount of zinc from the antiwear and friction system is less than 1000 ppm zinc based on the lubricating composition.

2. The lubricating composition of claim 1, wherein the calcium provided by the detergent system is provided by one or more of a calcium phenate, a calcium sulfonate, or mixtures thereof and in amounts to provide about 900 to about 1500 ppm of calcium.

3. The lubricating composition of claim 1, wherein the detergent system includes about 50 to about 70 weight percent of calcium phenate, about 30 to about 40 weight percent of magnesium sulfonate, and 0 to about 10 weight percent of calcium sulfonate.

4. The lubricating composition of claim 3, wherein the detergent system includes about 60 to about 70 weight percent of the calcium phenate, about 32 to about 38 weight percent of the magnesium sulfonate, and about 1 to about 4 weight percent of the calcium sulfonate.

5. The lubricating composition of claim 4, wherein the calcium sulfonate has a total base number of less than 50.

6. The lubricating composition of claim 1, wherein the antiwear and friction system includes two zinc dialkyl dithiophosphates.

7. The lubricating composition of claim 4, wherein the antiwear and friction system includes a first zinc dialkyl dithiophosphate derived from primary alcohols and a second zinc dialkyl dithiophosphate derived from a mixture of primary and secondary alcohols.

8. The lubricating composition of claim 1, wherein the antiwear and friction system includes one or more zinc dialkyl dithiophosphate additives derived from a majority of primary alcohols.

9. The lubricating composition of claim 7, wherein the antiwear and friction system includes up to about 60 weight percent of the first zinc dialkyl dithiophosphate derived from primary alcohols and about 40 to about 50 weight percent of the second zinc dialkyl dithiophosphate derived from a mixture of primary and secondary alcohols.

10. The lubricating composition of claim 9, wherein the second zinc dialkyl dithiophosphate derived from a mixture of primary and secondary alcohols is derived from about 50 to about 70 weight percent primary alcohols and about 30 to about 50 weight percent secondary alcohols.

11. The lubricating composition of claim 1, wherein the detergent system includes a calcium sulfonate with a neat total base number of 20 to 80.

12. The lubricating composition of claim 1, wherein the detergent system includes a calcium phenate with a neat total base number of 300 to 450 and a magnesium sulfonate with a neat total base number of about 500 to about 700.

13. The lubricating composition of claim 1, further comprising a viscosity modifier additive selected from polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof.

14. The lubricating composition of claim 13, wherein the lubricating composition includes no more than about 9 weight percent of the viscosity modifier additive.

15. The lubricating composition of claim 1, wherein the lubricating composition exhibits no more than 5 average events pursuant to a Sequence IX low speed pre-ignition test pursuant to ASTM D8291-21a using two iterations.

16. A lubricating composition suitable for diesel and gasoline engines, the lubricating composition comprising:

a detergent system providing both calcium and magnesium from one or more of a sulfonate, a phenate, a salicylate, or mixtures thereof and wherein a weight ratio of the calcium-to-magnesium provided by the detergent system is about 1.5:1 to about 2:1; and an antiwear and friction system including one or more metal dialkyl dithiophosphates derived from primary and secondary alcohols, and wherein a weight ratio of primary to secondary alcohols in the antiwear and friction system is at least about 3:1 to about 5.5:1;

wherein the amount of magnesium from the detergent system is at least 500 ppm magnesium based on the lubricating composition; and wherein the amount of phosphorus from the antiwear and friction system is less than 1200 ppm phosphorus based on the lubricating composition and the amount of zinc from the antiwear and friction system is less than 1000 ppm zinc based on the lubricating composition;

wherein the lubricating composition exhibits no more than 5 average events pursuant to a Sequence IX low speed pre-ignition test pursuant to ASTM D8291-21a using two iterations; and wherein the lubricating composition has an absolute value percent change from initial slip time of about 10 percent or less pursuant to Allison Transmission friction test TES-439 (November 2010) and an absolute value percent change from initial friction coefficient (midpoint) of 10 percent or less pursuant to Allison Transmission friction test TES-439 (November 2010).

17. A method of lubricating an engine with a lubricating composition that conforms with API SP, API CK-4, and API FA-4 certifications, the method comprising lubricating the engine with a lubricating composition, the lubricating composition including a detergent system providing both calcium and magnesium from one or more of a sulfonate, a phenate, a salicylate, or mixtures thereof and wherein a weight ratio of the calcium to magnesium provided by the detergent system is about 1.5:1 to about 2:1; and an antiwear and friction system including two or more zinc dialkyl dithiophosphates derived from primary and secondary alcohols, wherein a first metal dialkyl dithiophosphate is derived from primary alcohols and a second metal dialkyl dithiophosphate is derived from a mixture of primary and secondary alcohols, and wherein a weight ratio of primary to secondary alcohols from the two or more metal dialkyl dithiophosphates combined in the antiwear and friction system is at least about 3:1 to about 5.5:1; wherein the amount of magnesium from the detergent system is greater than 500 ppm magnesium based on the lubricating composition; and wherein the amount of phosphorus from the antiwear and friction system is less than 1200 ppm phosphorus based on the lubricating composition and the amount of zinc from the antiwear system is less than 1000 ppm zinc based on the lubricating composition; and wherein the wherein the lubricating composition exhibits no more than 5 average events pursuant to a Sequence IX low speed pre-ignition test pursuant to ASTM D8291-21a when using two iterations and wherein the lubricating composition has an absolute value percent change from initial slip time of about 10 percent or less pursuant to Allison Transmission friction test TES-439 (November 2010) and an absolute value percent change from initial friction coefficient (midpoint) of 10 percent or less pursuant to Allison Transmission friction test TES-439 (November 2010).

18. The method of claim 17, wherein the calcium provided by the detergent system is provided by one or more of a calcium phenate, a calcium sulfonate, or mixtures thereof and in amounts to provide about 900 to about 1500 ppm of calcium.

19. The method of claim 17, wherein the detergent system includes about 50 to about 70 weight percent of a calcium phenate, about 30 to about 40 weight percent of a magnesium sulfonate, and about 0 to about 10 weight percent of a calcium sulfonate.

20. The method of claim 19, wherein the detergent system includes about 60 to about 70 weight percent of the calcium phenate, about 32 to about 38 weight percent of the magnesium sulfonate, and about 1 to about 4 weight percent of the calcium sulfonate.

21. The method of claim 20, wherein the calcium sulfonate has a total base number of less than 50.

22. The method of claim 17, wherein the antiwear and friction system includes a first zinc dialkyl dithiophosphate derived from primary alcohols and a second zinc dialkyl dithiophosphate derived from a mixture of primary and secondary alcohols.

23. The method of claim 17, wherein the antiwear and friction system includes one or more zinc dialkyl dithiophosphate additives derived from a majority of primary alcohols.

24. The method of claim 23, wherein the antiwear and friction system includes up to about 60 weight percent of a first zinc dialkyl dithiophosphate derived from primary alcohols and about 40 to about 50 weight percent of a second zinc dialkyl dithiophosphate derived from a mixture of primary and secondary alcohols.

25. The method of claim 17, wherein the detergent system includes a calcium sulfonate with a neat total base number of 20 to 80.

26. The method of claim 25, wherein the second zinc dialkyl dithiophosphate derived from a mixture of primary and secondary alcohols is derived from about 50 to about 70 weight percent primary alcohols and about 30 to about 50 weight percent secondary alcohols.

27. The method of claim 17, wherein the detergent system includes a calcium phenate with a neat total base number of 300 to 450 and a magnesium sulfonate with a neat total base number of about 500 to about 700.

* * * * *